United States Patent [19]

Elmer

[11] 4,188,067

[45] Feb. 12, 1980

[54] KNOCK-DOWN CHAIR

[76] Inventor: Steven A. Elmer, 8506 Owensmouth Ave., Canoga Park, Calif. 91304

[21] Appl. No.: 924,781

[22] Filed: Jul. 14, 1978

[51] Int. Cl.[2] ..... A47C 4/00

[52] U.S. Cl. ..... 297/442

[58] Field of Search ..... 297/442, 440

[56] References Cited

U.S. PATENT DOCUMENTS

| | | | |
|---|---|---|---|
| 521,395 | 6/1894 | Van Norman | 297/442 |
| 1,735,851 | 11/1929 | Burton | 297/442 |
| 1,747,900 | 2/1930 | Jenny | 297/442 |
| 2,486,987 | 11/1949 | Scarlett | 297/442 |
| 2,551,071 | 5/1951 | Tyng | 297/442 X |
| 2,632,498 | 3/1953 | Curtis | 297/442 |
| 2,720,253 | 11/1955 | Turner et al. | 297/442 |
| 3,300,245 | 1/1967 | Rumble | 297/442 X |
| 3,547,491 | 12/1970 | Bovasso | 297/442 |
| 4,082,356 | 4/1978 | Johnson | 297/442 |

*Primary Examiner*—Francis K. Zugel

*Attorney, Agent, or Firm*—Nilsson, Robbins, Dalgarn, Berliner, Carson & Wurst

[57] ABSTRACT

A chair of knock-down construction includes a back, a seat in locked engagement with the back, and first and second legs in locked engagement with the back and seat. Each of the legs includes a corner portion having wall structure, defining slots, for holding the back and seat in locked engagement. The back includes two lower side corner portions, each defining a pair of projections for holding a leg and the seat in locked engagement. In addition, the seat includes two rear corner positions having wall structure, defining two cut-out holes; and the wall structure defining each hole concurrently engages the back and a leg. Each cut-out hole includes a slot portion and a pair of projection-receiving portions which intersect the slot portion. The chair, which is assembled, without fasteners, from interlocking components, further includes a cross-support in locked engagement with each of the legs, which supports the seat.

3 Claims, 6 Drawing Figures

KNOCK-DOWN CHAIR

FIELD OF THE INVENTION

This invention relates to furniture, more particularly to chairs that can be quickly assembled and disassembled and compactly stored.

BACKGROUND AND SUMMARY OF THE INVENTION

Knock-down furniture, i.e., furniture which can be and is made to be quickly assembled and disassembled, by definition offers certain advantages over conventional furniture. A capability for assembly without fasteners, glue, etc., is an additional feature which has been provided in some furniture of a knock-down type of construction. The assembly of knock-down furniture is of course generally provided for by forming the furniture of interlocking components.

In the development of such furniture, creating pieces which are both simple and sturdy is a primary challenge. Ease of construction of the components and ease of storage are additional goals. Ease of construction, of course, decreases cost, and ease of storage increases, for many applications, the value of the furniture. Thus, for example, to a user of a fully-loaded camper or a backpacker, or anyone with relatively limited storage capacity, furniture that can be compactly stored may present an important advantage.

Bovasso U.S. Pat. No. 3,547,491 and Rumble U.S. Pat. No. 3,300,245 provide examples of furniture made of interlocking components with the aforementioned goals somewhat in mind. Bovasso discloses a chair, which may be formed from a single piece of material, including a back, four legs, a seat and a support piece, and which utilizes slots to hold the components together. Rumble similarly discloses a picnic table, including a child's chair, similarly using slots, tabs and tab-receiving wall structure. Basile U.S. Pat. No. 2,628,668 and Curtis U.S. Pat. No. Des. 166,660 are of more limited interest.

The present invention includes furniture components and structure providing, among other qualities, a degree of simplicity, a sturdiness of construction and a relative maximum use of construction material, which are of great value to both furniture manufacturers and users.

In accordance with the invention, a chair of knock-down construction includes: a back; a seat in locked engagement with the back; and first and second legs in locked engagement with the back and seat, which each include a corner portion having wall structure, defining slots, for holding the back and seat in locked engagement. In accordance with more specific features: the chair may be assembled, without fasteners, from interlocking components; the legs may each have a substantially triangular shape; and the chair may further include a cross-support, extending between the legs, in locked engagement with each of the legs.

In accordance with other aspects of the invention, a chair of knock-down construction includes: first and second legs; a seat in locked engagement with the first leg and the second leg; and a back which includes a lower side corner portion defining a projection for holding the first leg and seat in locked engagement. A second projection may be included for similarly holding the first leg and seat in locked engagement; and a second lower side corner portion may define a projection for holding the second leg and seat in locked engagement.

In accordance with still other aspects of the invention, a chair of knock-down construction includes: two legs, each including a corner portion; a back, in locked engagement with each of the legs, the back including two corner portions; and a seat, in locked engagement with each of the legs and with the back, the seat including two corner portions; wherein the locked engagement is accomplished solely by wall structure defined by the aforesaid corner portions. A cross-support, in locked engagement with the legs, may provide support for the seat.

In accordance with yet other aspects of the invention, a chair includes: first and second legs; a back; and a seat having wall structure, defining a cut-out hole, for concurrently engaging the back and first leg. In accordance with more detailed features: the cut-out hole may include a slot portion, at least in part defined by the wall structure for engaging the first leg, and two projection-receiving portions, which each may intersect the slot portions and which, at least in part, are defined by wall structure for engaging projections formed along the back. In accordance with additional detailed features: the projections may engage the first leg; and other wall structure, defining a second cut-out hole, may act in analogous fashion with respect to other peojections formed along the back and the second leg.

DETAILED DESCRIPTION

Figure 1:
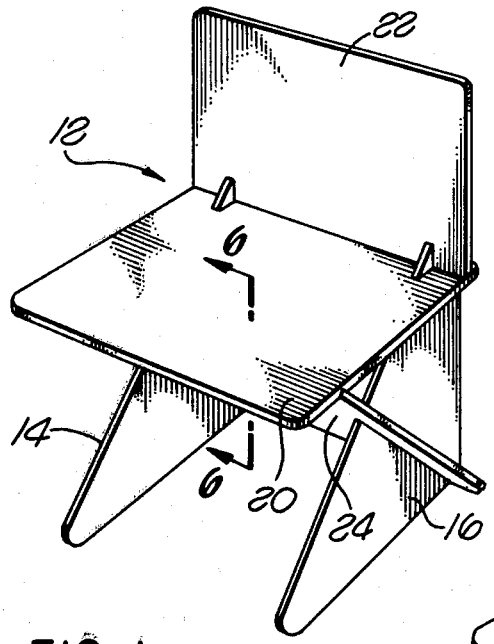
FIG. 1 is a perspective view of a chair in accordance with the invention.

Referring to FIG. 1, a chair 12 is formed of five interlocking components: a left (from the front of the chair) leg or base 14, a right leg or base 16, a seat 20, a back 22 and a cross-support 24. By reference to FIG. 1 and the remaining figures, it may be appreciated that the chair is assembled without the use of any fasteners, solely from the five interlocking components. Thus, the chair is not only of a knock-down type of construction, i.e., adapted for quick assembly and disassembly, but employs no fasteners. Also, it requires no glue or other adhesives. By reference to FIG. 2, it may also be appreciated that the components may be cut from a single piece of material, for example plywood, and that a relative minimum of material is wasted in the cutting process and a relative maximum is preserved and used in the chair.

Figure 3:
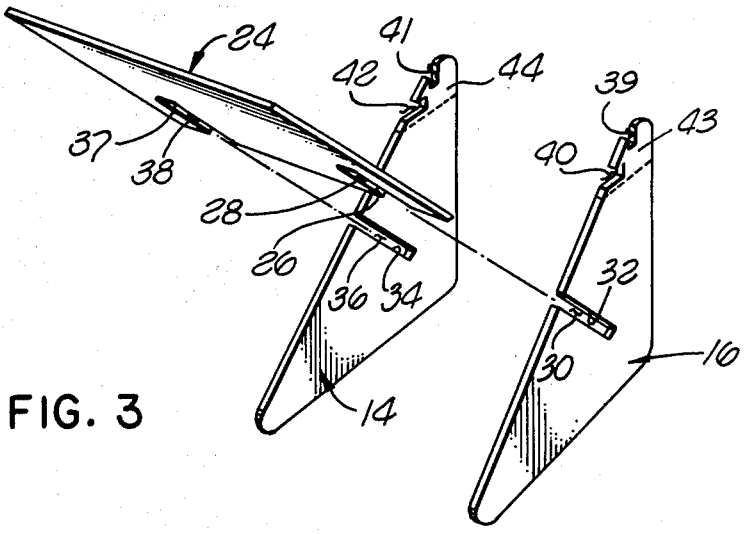
FIG. 3 is an exploded perspective view showing three components of the chair of FIG. 1.

Referring to FIG. 3, the cross-support 24 includes right, slot-defining wall structure 26, defining a right support slot 28 which mates with an intermediate right leg slog 30 defined by intermediate, slot-defining wall structure 32 along the right leg 16. The right, slot-defining wall structure, by abutting engagement with the right leg (see, e.g., FIG. 4), functions as a locking element in the locking of the cross-support to the right leg. The intermediate slot-defining wall structure, by similar abutting engagement with the cross-support (see, e.g., FIG. 4) similarly serves as an element in the locking of the cross-support to the right leg. Analogous intermediate, slot-defining wall structure 34 of the left leg 14, defining an intermediate left leg slot 36, along with left, slot-defining wall structure 37 of the cross-support, defining a left support slot 38 in the cross-support, act with respect to the cross-support 24 and the left leg 14, analogously to the respectively comparable aforementioned wall structure. The right leg 16 also defines a vertical corner slot 39 and a horizontal corner slot 40 which are employed in the locking engagement of the seat, back and right leg 16. The left leg similarly defines a vertical corner slot 41 and a horizontal corner slot 42 which are utilized in the locking emgagement of the seat, back and left leg 14. The two pairs of corner slots are defined by structure included in upper corner portions of the legs, generally respectively designated at 43 (right leg) and 44 (left leg).

Figure 5:
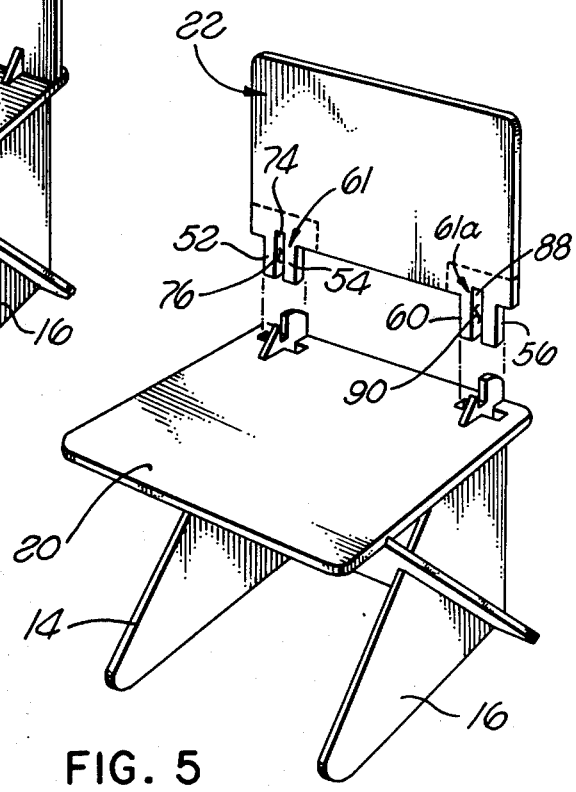
FIG. 5 is a partially exploded perspective view of the chair of FIG. 1.
Figure 2:
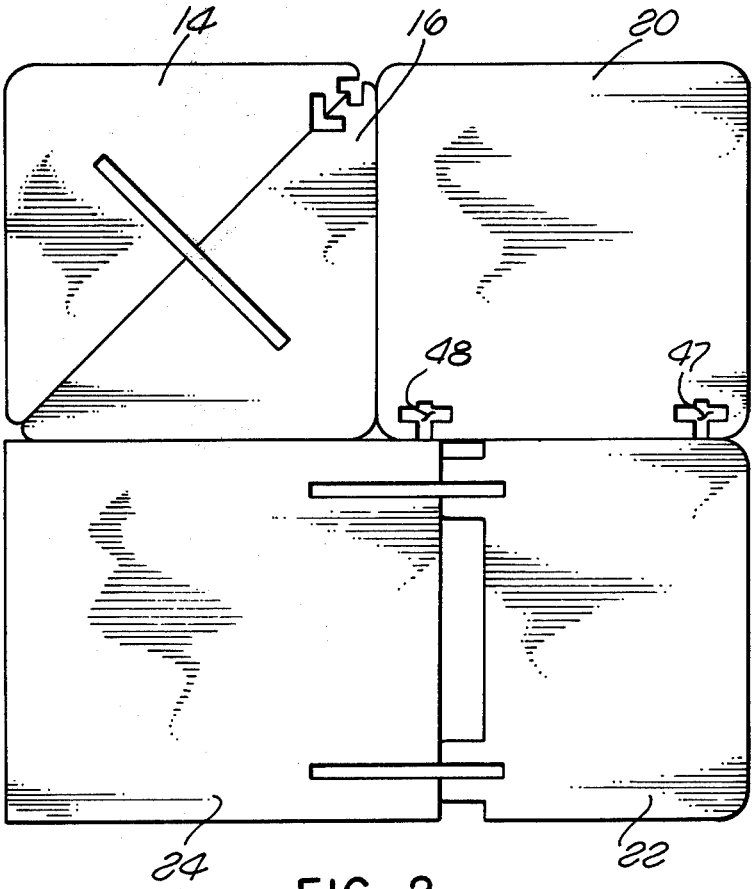
FIG. 2 is a plan view of the components of the chair of FIG. 1, showing how they may be formed from a single piece of material.
Figure 4:
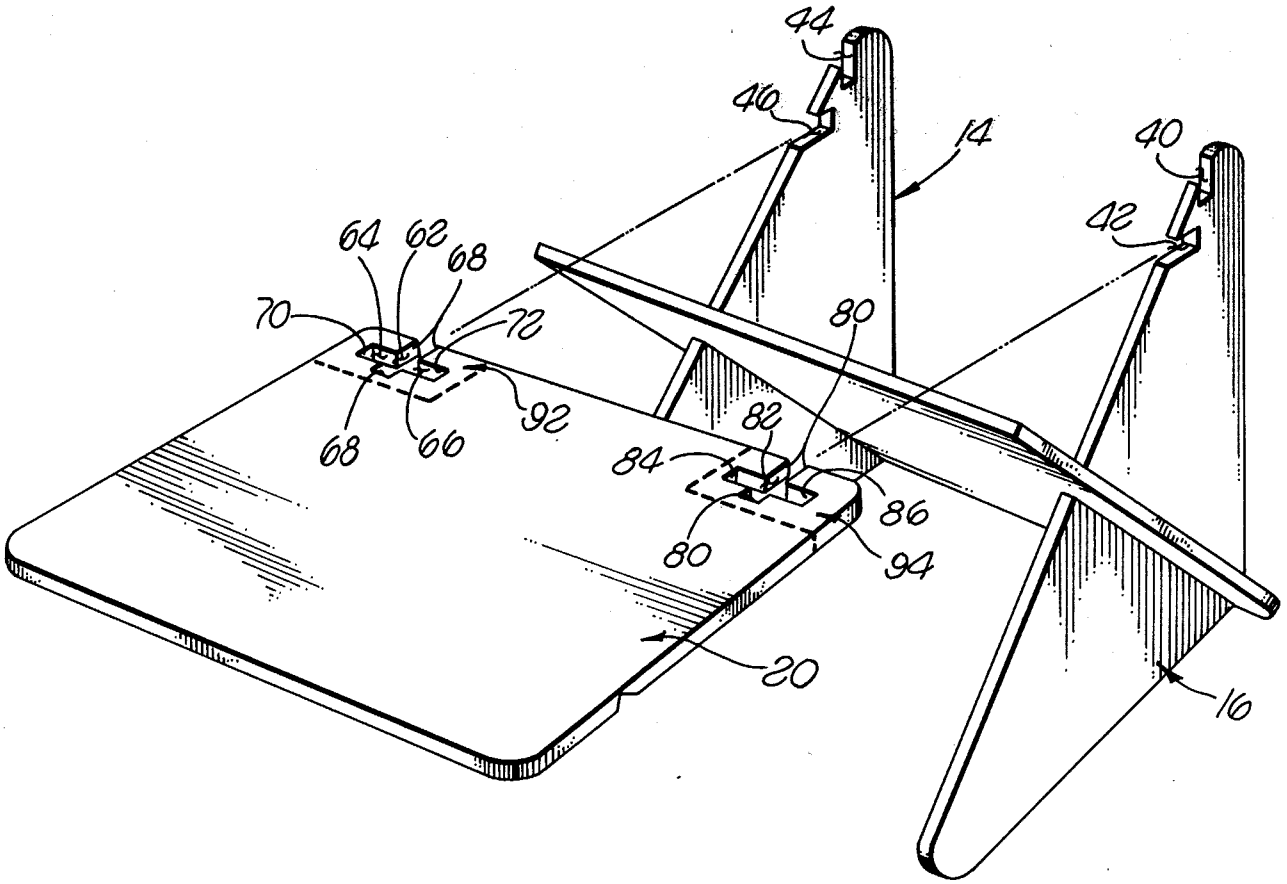
FIG. 4 is a partially exploded perspective view showing the components of FIG. 3 and an additional component.

Referring to FIGS. 2, 4 and 5, these left and right leg corner slots respectively act in cooperation with a left rear cut-out hole 47 and a right rear cut-out hole 48 (FIG. 2), formed by seat wall structure, and with a pair of left corner projections, defined along a lower left side corner portion of the back 22, and a pair of right corner projections, defined along a lower right side corner portion of the back (see FIGS. 4 and 5). The left corner projections include a left outside projection 52 and a left inside projection 54; and the right corner projections include a right outside projection 56 and a right, inside projection 60. It is noted that these projections are along lower left side and lower right side corner portions in the sense that they are formed at two lower corner portions, respectively generally designated at 61 (left) and 61*a* (right), generally associated with an upright rectangular-shaped element. The left rear cut-out hole 47 (see FIG. 2) includes (see FIG. 4) a slot portion 62 and outside and inside projection-receiving portions 64 and 66. These projection-receiving portions each intersect an intermediate portion of the slot portion to form the cross-shaped cut-out hole. The slot portion 62 is in part defined by slot-defining wall structure 68; the outside, projection-receiving portion 64 is in part defined by outside, projection-engaging wall structure 70; and the inside, projection-receiving portion is in part defined by inside, projection-engaging wall structure 72.

By reference to FIGS. 4 and 5, it can now be appreciated that in the locked engagement of the left leg 14, seat 20 and back 22, at the left, rear of the chair, the just-mentioned slot-defining wall structure engages, in abutting fashion, the left leg 14; the outside 70 and inside 72 projection-engaging wall structure (of the seat) respectively engage, in abutting fashion, the left outside 52 and left inside 54 projections (of the back); and wall structure 74, in part along these projections, defining a left back slot 76, engages, in similar abutting fashion, the left leg 14. The interactions involving wall structure 80 in part defining a slot portion 82 of the right rear cut-out hole 48, wall structure 84 and 86 respectively in part defining an inside, projection-engaging portion 84 and an outside, projection-engaging portion 86 of the hole, as well as the right outside projection 56 and right inside projection 60, and back wall structure 88 defining a right back slot 90, in the locking of the back 22, seat 20 and right leg 16, at the right, rear of the chair, are analogous to the previously described interactions at the left, rear of the chair.

It will be appreciated that, in each case, parts of the back 22 and of a leg are concurrently positioned in the cut-out hole and in abutting engagement with structure defining the cut-out hole. It will also be appreciated that, along with this concurrent positioning and engagement, a pair of projections is also in concurrent abutting engagement with the leg.

In addition, it is noted that the left rear cut-out hole 47, described above, is defined by a left rear corner portion of the seat, generally designated at 92, and that the right rear cut-out hole 48, similarly described, is defined by a right rear corner portion of the seat, generally designated at 94 (see FIG. 4). Along these lines, it may be appeciated that the structure at the lower left side, and lower right side corner portions of the back 22, at the left and right rear corner portions of the seat 20 and at the upper corner portions of the left and right legs 14 and 16, as well as the substantially triangular shape of the legs, contribute greatly to the simplicity of formation of the components, the ease of assembly of the components and the sturdiness of the assembled chair. It will further be appreciated that the locked engagement of the back 22 and seat 22 with each other and with the left and right legs 14 and 16, is achieved essentially solely by the structure at these corner portions.

Figure 6:
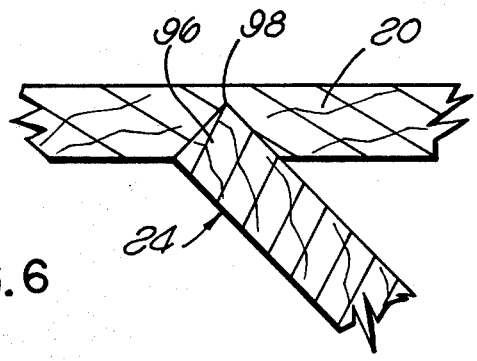
FIG. 6 is a cross-sectional view taken along the line 6—6 of FIG. 1.

Support for the seat 20, in addition to that provided at the rear of the seat, is provided by the cross-support 24. Referring to FIGS. 1 and 6, it may be seen that the underside of the seat 20 forms a groove along the width of the seat, with the length of the groove thus generally corresponding to the width of the seat and of the cross-support 24. An elongated triangular-shaped part 96 of this cross-support mates with this groove, thus enabling the cross-support to provide additional support for the seat 20. The width of the cross-support, which determines the length of an edge 98 of the support, which is received by the groove, could alternatively, for example, be made less than the width of the seat, with a corresponding decrease in the length of the groove so that it will not extend to the sides of the seat.

Referring to FIG. 2, it may be appreciated that various rounded edges might be left squared-off to provide additional ease in the formation of the components of the chair 12. It will additionally be appreciated that the embodiment described is given by way of illustration and that various modifications and changes may be made without departing from the spirit of the invention.

What is claimed is:

1. A chair of knock-down construction, comprising:

two legs, each including an upright corner portion;

a back in locked engagement with each of said legs, said back including two lower corner portions each formed with a slotted projection;

a seat in locked engagement with each of said legs and with said back, said seat including two rear corner portions;

said locked engagement being accomplished by wall structure defined by said corner portions comprising mutually engaging slots through the rear surface of each rear corner portion of said seat and the forward surface of each upright corner portion of said legs, a hole through each rear seat corner portion intersecting the slot thereat for receiving respective back lower corner projections, the slots through the bottom surface of each lower corner projection of said back and each upright corner portion of said legs being mutually engaging when said projections are received in said rear seat corner holes, each projection engaging the upright corner portions of each leg on opposite surfaces thereof.

2. The chair of claim 1 further comprising a cross-support in locked engagement with said legs for supporting said seat.

3. The chair of claim 1 or 2 wherein said hole is substantially cross-shaped.

* * * * *

UNITED STATES PATENT AND TRADEMARK OFFICE

CERTIFICATE OF CORRECTION

PATENT NO. : 4,188,067

DATED : February 12, 1980

INVENTOR(S) : Steven A. Elmer

It is certified that error appears in the above-identified patent and that said Letters Patent are hereby corrected as shown below:

Col. 2, line 27, delete "peojections" and substitute therefor --projections--.

Col. 3, line 17, delete "emgagement" and substitute therefor --engagement--.

Col. 4, line 25, delete "22", second occurrence and substitute therefor --20--.

Signed and Sealed this

*Twenty-second* Day of *July 1980*

[SEAL]

*Attest:*

SIDNEY A. DIAMOND

*Attesting Officer*

*Commissioner of Patents and Trademarks*